US009634406B2

(12) United States Patent
Pizzi

(10) Patent No.: US 9,634,406 B2
(45) Date of Patent: Apr. 25, 2017

(54) SWITCHBOARD MULTIFUNCTION TERMINAL BLOCK FOR CONNECTING ELECTRICAL WIRES

(71) Applicant: MORSETTITALIA S.p.A., Milan (IT)

(72) Inventor: Giordano Pizzi, Milan (IT)

(73) Assignee: MORSETTITALIA S.p.A., Milan (IT)

( * ) Notice: Subject to any disclaimer, the term of this patent is extended or adjusted under 35 U.S.C. 154(b) by 0 days.

(21) Appl. No.: 15/016,660

(22) Filed: Feb. 5, 2016

(65) Prior Publication Data

US 2016/0233593 A1 Aug. 11, 2016

(30) Foreign Application Priority Data

Feb. 5, 2015 (IT) ..... MI2015A0150

(51) Int. Cl.
*H01R 9/26* (2006.01)
*H01R 13/627* (2006.01)

(52) U.S. Cl.
CPC ..... *H01R 9/26* (2013.01); *H01R 9/2625* (2013.01); *H01R 9/2675* (2013.01); *H01R 13/6273* (2013.01)

(58) Field of Classification Search
CPC ..... H01R 9/24; H01R 13/514; H01R 9/26; H01R 9/2608; H01R 9/2675; H01R 9/2625
USPC ..... 439/709, 716, 715, 110, 121
See application file for complete search history.

(56) References Cited

U.S. PATENT DOCUMENTS 3,665,376 A * 5/1972 Paris ..... H01R 9/24 439/721
5,853,304 A * 12/1998 Landreau ..... H01R 31/085 439/716
7,192,316 B1 * 3/2007 Pollmann ..... H01R 9/2675 439/716

(Continued)

FOREIGN PATENT DOCUMENTS

EP 0 760 539 A2 3/1997
EP 2 204 886 A1 7/2010

(Continued)

OTHER PUBLICATIONS

Search Report and Written Opinion for Italian Application No. MI2015A000150, mailed Sep. 23, 2015.

(Continued)

*Primary Examiner* — Hae Moon Hyeon

(57) ABSTRACT

A switchboard multifunction terminal block for connecting electrical wires, comprising a first pair of seats situated more externally in the longitudinal direction, being designed to house a clamp for gripping wires; a first space centered on the vertical central axis for housing a screw-type jumper of the type with a screw; a pair of second spaces respectively arranged symmetrically on opposite sides of the first space relative to the vertical central axis, each second space being bounded in the longitudinal direction by respective second partitions extending in the vertical direction, the size of each space allowing housing of a respective jumper of the type with spring lugs, the top side of the terminal block having an undercut with base provided with three openings forming the external connection, respectively, of the first space and the pair of spaces for inserting the respective jumper.

6 Claims, 7 Drawing Sheets

(56) References Cited

U.S. PATENT DOCUMENTS

| | | | | |
|---|---|---|---|---|
| 7,862,389 | B2 * | 1/2011 | Pizzi | H01R 4/28 439/709 |
| 2008/0070450 | A1 * | 3/2008 | Pizzi | H01R 4/28 439/709 |
| 2008/0248698 | A1 * | 10/2008 | Pizzi | H01R 13/68 439/709 |
| 2011/0014808 | A1 | 1/2011 | Diessel | |
| 2014/0273592 | A1 | 9/2014 | Werner | |

FOREIGN PATENT DOCUMENTS

| | | | |
|---|---|---|---|
| EP | 2 214 267 | A1 | 8/2010 |
| EP | 2 583 357 | A1 | 4/2013 |
| WO | WO2011157772 | A1 | 12/2011 |

OTHER PUBLICATIONS

Lopez Garcia, R.; Search report from corresponding European Application No. 16154009.1; search completed Apr. 20, 2016.

* cited by examiner

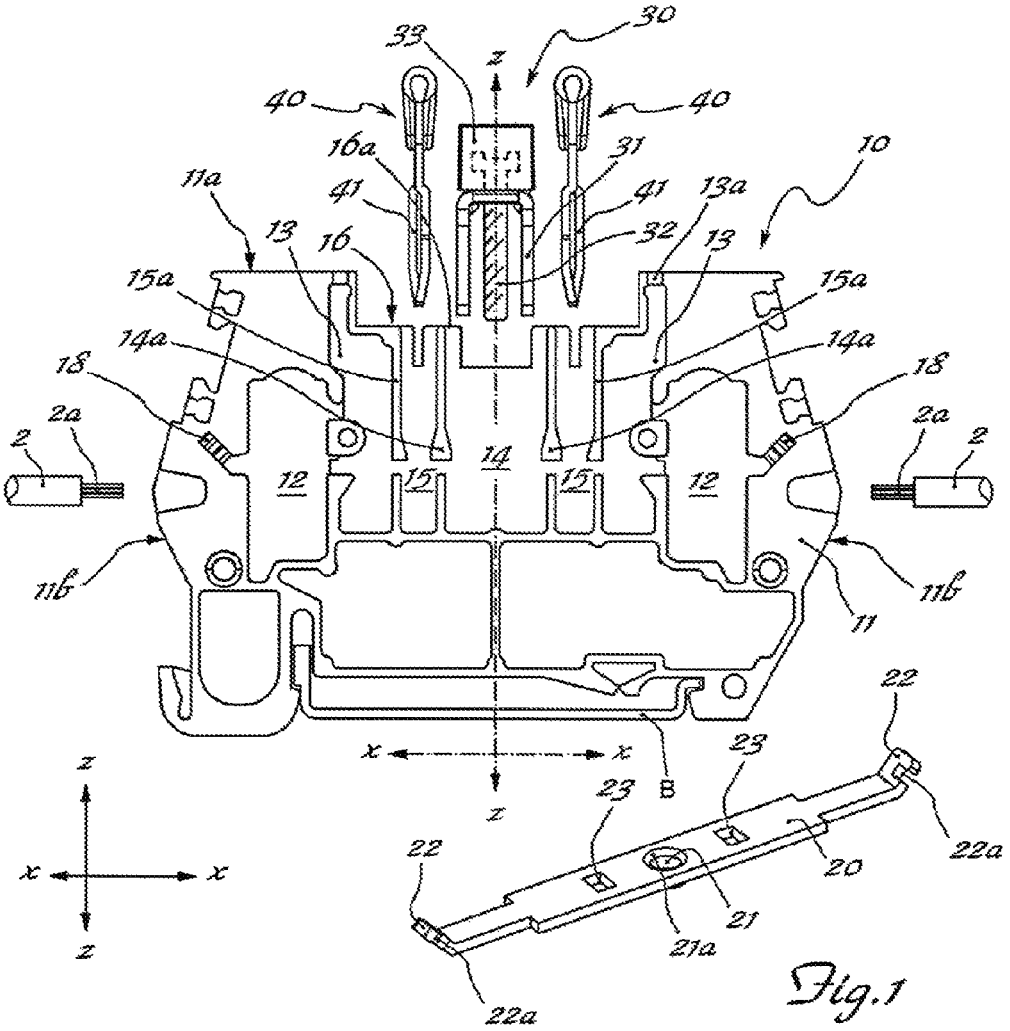
Fig.1
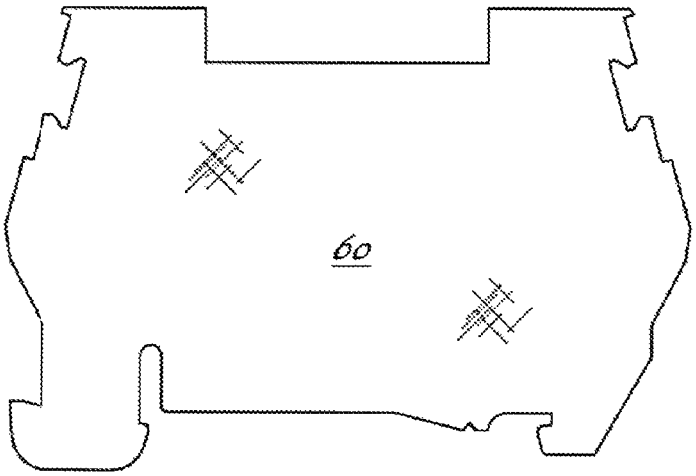

SWITCHBOARD MULTIFUNCTION TERMINAL BLOCK FOR CONNECTING ELECTRICAL WIRES

CROSS REFERENCE TO RELATED APPLICATION

This application claims the benefit of and priority to Italian Patent Application No. MI2015A 150, filed Feb. 5, 2015 the contents of which are incorporated herein by reference.

FIELD OF THE INVENTION

The present invention relates to a switchboard multifunction terminal block for connecting electrical wires.

DESCRIPTION OF RELATED ART

It is known, in the technical sector relating to the production of switchboards for the wiring of electrical installations, to use terminal blocks designed to be mounted on associated supports and to provide on the front side access to the retaining means—normally of the screw or spring type—for electrical wires to be connected in order to ensure continuity of the electric circuit section; said continuity being achieved by inserting inside a special seat, accessible from the top side, movable contact elements such as protection fuses, electric circuit breakers or jumpers for connecting together two adjacent terminal blocks.

It is also known that these jumpers may be:

configured with two spring lugs forming the element for engagement inside the seat of the terminal block assembly, with associated electrical contact in the transverse direction determined by the resilient force which pushes the contact legs against the walls of a hole in a longitudinal conductor lamina connecting together the means for retaining the electric wires; and of the screw type, with a conductor body in the form of an "overturned U", providing electrical contact in the vertical direction by means of contact of the feet of the overturned U body of the jumper with the longitudinal conductor lamina connecting the opposite means for retaining the electrical wires, said contact being determined by tightening of a screw inside the female thread of a hole formed in the said conductor lamina.

The two types have different dimensional measurements both in the transverse width/thickness direction of the terminal block and in the longitudinal lengthwise direction of the terminal block.

With the current terminals of the conventional type, it is therefore necessary to provide a specific and dedicated terminal for each type of movable contact and specifically for each of the two different types of spring or screw jumper, with an obvious increase in the production and warehouse management costs.

EP 0 760 539 A2 describes a terminal block with a first space (14) centred on the vertical axis and bounded in the longitudinal direction (X-X) by respective partitions extending in the vertical direction (Y-Y) by an amount such as to allow the insertion of a jumper of the screw type with L-shaped body or alternatively a pair of jumpers of the type with spring lugs specially designed for said central space.

EP 2 204 886 A1 describes a terminal block with a central space divided into two sub-spaces by a central dividing wall for receiving the separate legs of a shunt which may be for example a fuse, a relay or a signalling lamp.

The technical problem which is posed therefore is that of providing a terminal block, in particular of the type for switchboards designed for wired circuits, which allows the insertion equally well of both screw jumpers and spring jumpers, also simultaneously, without having to replace the terminal block when there is a variation in the type of contact to be inserted.

In connection with this problem, it is also required that this terminal block should have standard dimensions, so that the various types of terminal blocks can be classified in the same size categories and can be produced and assembled in an easy and low-cost manner, and that it should be designed to avoid errors during insertion of the different electrical contact jumpers with the consequent possibility of damaging the connected circuits.

SUMMARY OF THE INVENTION

These results are achieved according to the present invention by a terminal block for connecting electrical wires and designed to house, also simultaneously, jumpers of the spring and/or screw type, according to the features of the claims.

BRIEF DESCRIPTION OF THE DRAWINGS

Further details may be obtained from the following description of non-limiting examples of embodiment of the subject of the present invention, provided with reference to the accompanying drawings, in which:

FIG. 1: shows an exploded side view of a first preferred embodiment of the terminal block according to the present invention;

DETAILED DESCRIPTION OF THE DRAWINGS

Figure 2:
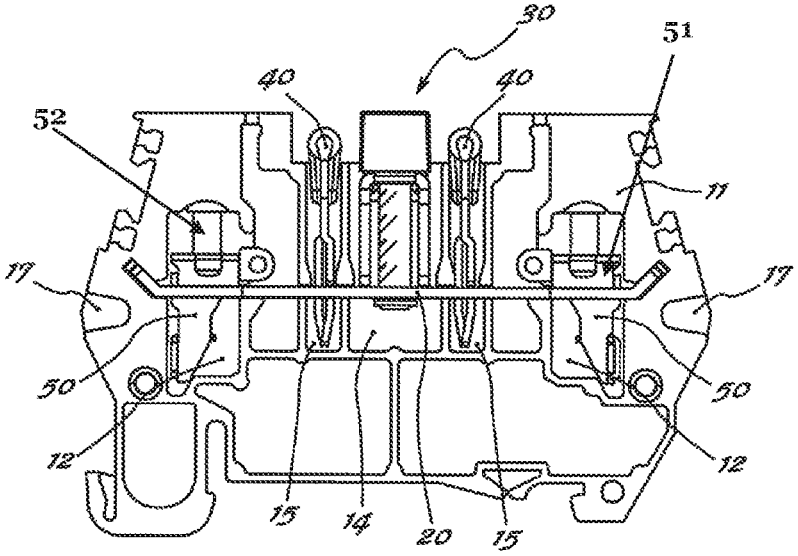
FIG. 2: shows a side view from the wide side of the terminal block according to FIG. 1 in the assembled and open condition.

As shown in FIG. 1 and assuming solely for the sake of easier description and without a limiting meaning a set of three reference axes, respectively in the longitudinal direction corresponding to the lengthwise dimension of the terminal block, transverse direction Y-Y, corresponding to the width or thickness of the terminal block, and vertical direction Z-Z, corresponding to the heightwise dimension of the terminal block, and for the sake of convenience coinciding with the vertical central axis of the terminal block, the terminal block according to the present invention comprises an insulating body 10 forming the container of the means (50) (FIG. 2) for retaining the free ends 2*a* of electrical wires 2. For the sake of easier description and solely for reference to the directional layout shown by way of example in the figures, a bottom side corresponding to the part for engagement with a Deutsches Institut für Normung (DIN)-standard rail B fixed to the electrical switchboard, not shown, and a visible top part, accessible for the user and opposite to the first part, will also be assumed.

As will emerge more clearly below, the terminal block may be completed so as to form the various electrical connections in the longitudinal direction X-X between the opposite wires 2 or in the transverse direction with other adjacent terminal blocks, respectively, by means of:

- a conductor lamina 20 extending in the longitudinal direction X-X for re-establishing the electrical continuity between the electrical wires 2 inserted in the opposite flanks of the terminal block;
- a jumper 30 of the screw type and/or at least one jumper 40 of the spring lug type.

In greater detail, said insulating body 10 has a frame 11 substantially in the form of a closed ring and formed so as to define at least one top side 11*a* and at least two respective flanks 11*b* arranged opposite to each other in the longitudinal direction X-X.

The insulating body 10 has, formed inside it, at least:

- a first pair of seats 12 which are outermost in the longitudinal direction X-X, towards the flanks 11, open in the transverse direction Y-Y and symmetrical relative to the vertical central axis Z-Z and designed to house gripping (retaining/releasing) devices 50 for connection wires 2.

Figure 4:
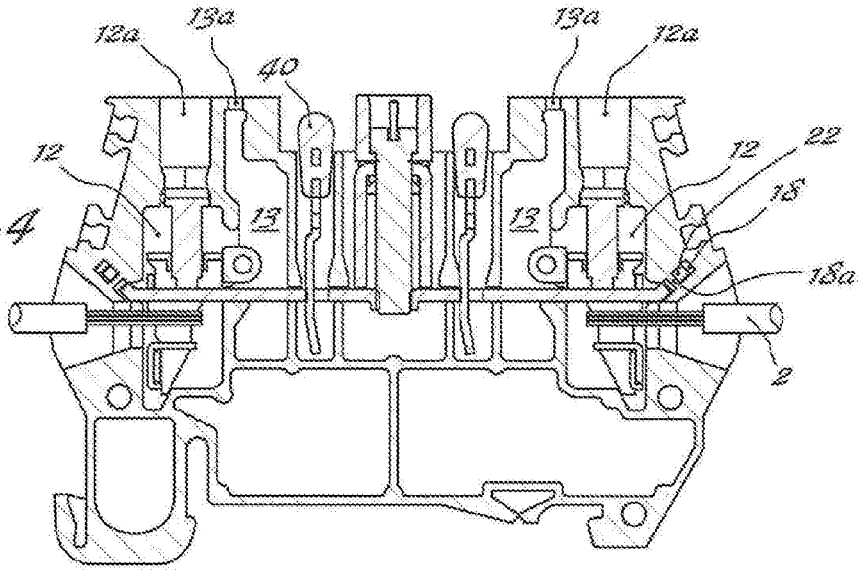
FIG. 4: shows a cross-sectional view, along a vertical plane, of the terminal block according to FIG. 12 in the assembled condition.
Figure 5:
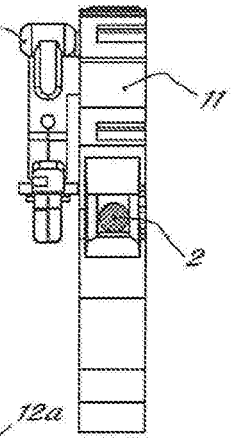
FIG. 5: shows a side view, from the narrow side, of the terminal block according to FIG. 4.

The top side 11*a* of the frame 11 may also be provided with (see FIG. 4):

- first openings 12*a* extending in the vertical direction Z-Z and in the longitudinal direction X-X, substantially superimposed on the respective seat 12 and designed to connect them with the exterior;
- holes 13*a* with a vertical axis Z-Z for insertion of a label/tag for identifying the circuit connections.

According to the invention, it is envisaged that the terminal block also comprises:

- a first space 14 centred on the vertical central axis Z-Z and bounded in the longitudinal direction X-X by respective first partitions 14*a* interrupted in the vertical direction Z-Z along a section having a height such as to allow insertion of the conductor lamina 20 suitable for restoring the electrical continuity between the opposite wires 2; the partitions 14*a* are spaced from each other in the longitudinal direction X-X by an amount such as to define a size of the space suitable for housing a jumper 30 of the type with screw 32 and conductor body in the form of an overturned U with vertical legs 31 and insulating body 33 for containing the head of the screw.
- a pair of second spaces 15 respectively arranged symmetrically on opposite sides of the first space 14; each second space 15 is bounded in the longitudinal direction X-X by respective second partitions 15*a* interrupted in the vertical direction Z-Z along a section with a height such as to allow insertion of the conductor lamina 20; the partitions 15*a* are spaced in the longitudinal direction X-X from the first partitions 14*a* by an amount such as to define a size of the second space 15 suitable for housing a respective jumper 40 of the type with spring lugs 41, The screw-type jumper 30 and spring-lug jumper 40 are not described in detail since they are of the conventional type.

Along the top side 11*a*, the terminal block has an undercut 16 with a base 16*a* provided with a first central opening 16*b* and two second lateral openings 16*c* arranged on opposite sides of the central opening 16*b*. The three openings 16*b* and 16*c* form the openings towards the top side 11*a* of the first space 14 and the pair of second spaces 15, respectively, for insertion, in the vertical direction Z-Z, of the respective screw-type jumper 30 with conductor body and/or spring-lug jumper 40, via the top side 11 a accessible for the operator also once the terminal block has been mounted on the electric switchboard.

Each flank 11*b* of the frame 11 is provided with a respective insertion opening 17 for introducing the wire 2 in the longitudinal direction X-X.

The conductor lamina 20, which in use connects the opposite wires 2 together, extends in the longitudinal direction X-X.

Preferably the opposite free ends of the lamina 20 form a tip 22 inclined upwards and designed to engage with a corresponding internal seat 18 provided on each flank 11*b* of the frame 11 so as to stably fasten the conductor lamina 20 to the insulating body 10.

Preferably, each tip 22 has an incision 22*a* designed to engage with a corresponding relief 18*a* in the seat 18 in order to axially retain the lamina when it undergoes an axial deformation owing to the thrust exerted by the screw of the means for retaining the wire 2.

The conductor lamina 20 has a first central hole 21, with female thread 21*a* suitable for mating with the thread of the screw 32 of the screw-type jumper 30, and a pair of openings 23 with a polygonal, preferably quadrangular form as shown, arranged preferably in a symmetrical manner on opposite sides of the central hole 21 for connection with the contact spring lugs 41 of the spring-lug jumper 40.

During use (FIG. 2), the hole 21 and the openings 23 will be respectively coaxial with the first and second spaces 14 and 15 so as to allow the conductive connection with the corresponding screw-type jumper 30 or spring-lug jumper 40, once it has been fully inserted inside the terminal block. Preferably, the central hole 21 is obtained by means of deep-drawing so as to form an extended collar 21*b* in the vertical direction Z-Z designed to allow better screwing-in of the screw 32 of the screw-type jumper 30, further favouring a better conductive contact.

Figure 3:
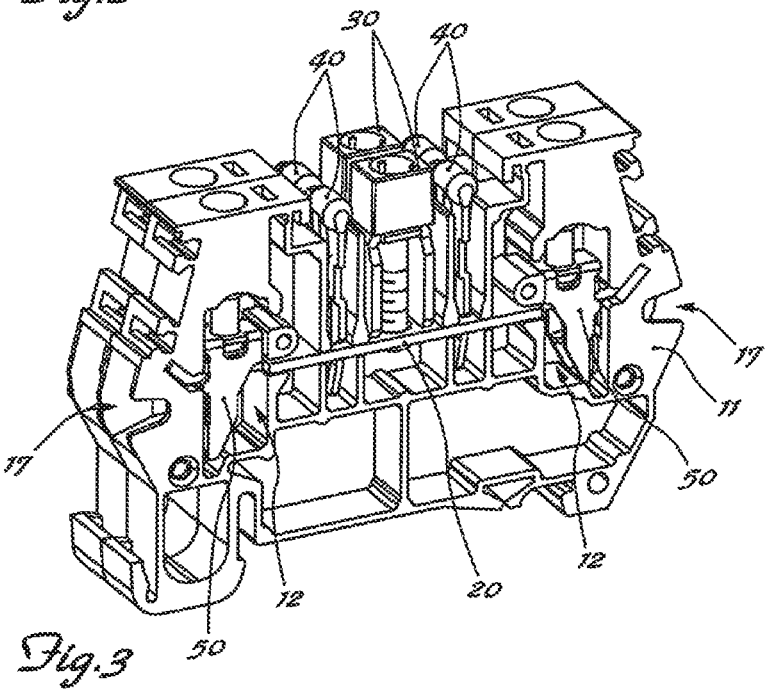
FIG. 3: shows a perspective view of a pair of terminal blocks according to FIG. 2 in the assembled condition.

In the example shown in FIGS. 2 and 3 means 50 for retaining the electric wire 2 are of the clamp type 51 with actuating screw 52; the head of said screw 52 is accessible from the outside by means of the said hole 13*a* with vertical axis Z-Z through which it is possible to insert the operating tool for rotating the screw, the tip of which, reacting against the surface of the conductor lamina 20, recalls the clamp which grips the end 2*a* of the wire 2 between clamp and lamina.

Although not shown, it is envisaged that the means for retaining the wire 2 may be of the spring type.

As shown:

- the laterally open terminal block 10 is assembled by inserting inside it in the vertical direction Y-Y:
- the conductor lamina 20, so that its opposite raised ends enter inside the respective seat of the terminal block;
- the means 50 for retaining the wire 2;
- any signalling devices electrically connected to the electric terminals;
- closing the terminal block with a cover 60;
- inserting the wires 2 inside the respective insertion openings 17 and operating the actuating screw of the retaining means so as to grip the said wires against the conductor lamina;
- inserting at least either one of the screw-type jumper 30 or spring-lug jumper 40 inside the respective first 14 or second 15 space;
- in the case of a screw jumper, the said screw is operated so as to engage by means of its thread with the female thread 21*a* of the hole 21 in the lamina 20 which presses the conducting legs of the jumper against the said lamina;
- in the event of a jumper 40 with spring lugs 41, this is pushed down fully in the vertical direction of insertion so that the spring lugs enter inside the respective opening 23 and produce the electrical conductive contact by means of the resilient thrust of the contact spring lugs 41 against the internal surface of the openings 23 of the conductor lamina 20.

Figure 6:
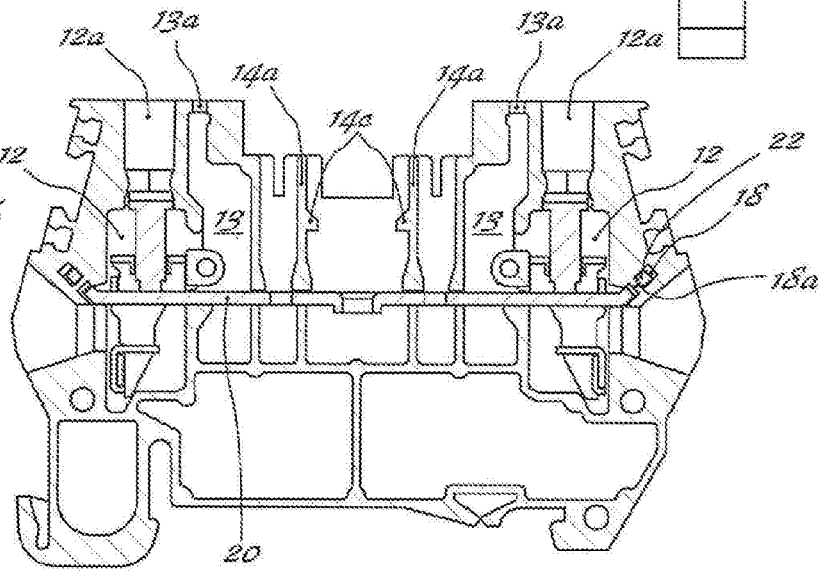
FIG. 6: shows a cross-sectional view, along a vertical plane, of a second preferred embodiment of the terminal block according to the invention.

As shown in FIG. 6, a second preferred embodiment of the terminal block according to the invention is envisaged, said embodiment having a frame 11 similar to that already described and for which the same reference numbers will be used for parts which remain unchanged.

In such an embodiment, each vertical partition 14a bounding the first space 14 has a tooth 14*c*—which is preferably rigid—extending towards the inside of the seat 14; the two teeth 14*c* are designed to cooperate with corresponding and complementary teeth 214*c*—resiliently deformable in the longitudinal direction X-X—of an add-on terminal block 100 which can be mounted on the terminal block according to the invention in the vertical direction Z-Z via the top part thereof.

Figure 7:
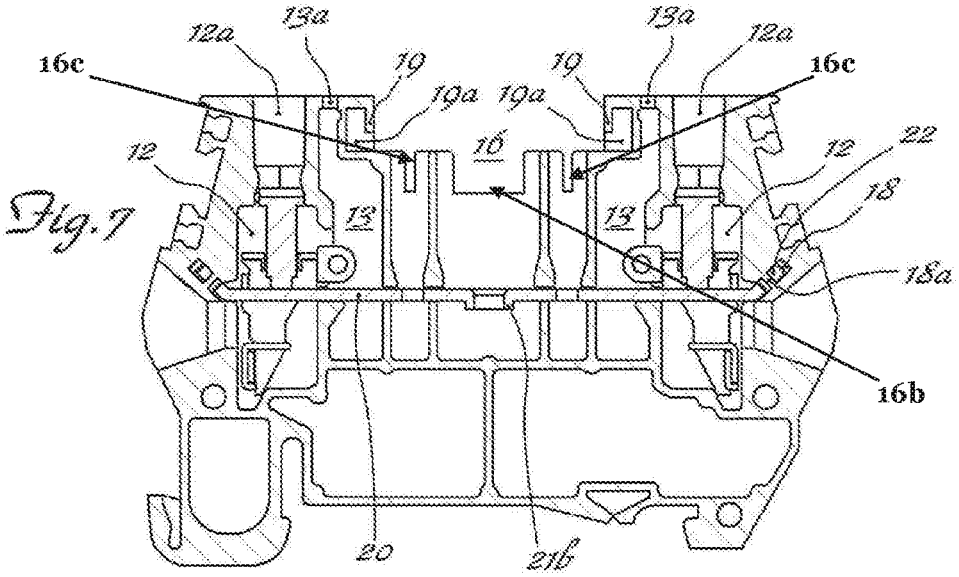
FIG. 7: shows a cross-sectional view, along a vertical plane, of a third preferred embodiment of the terminal block according to the invention.
Figure 8:
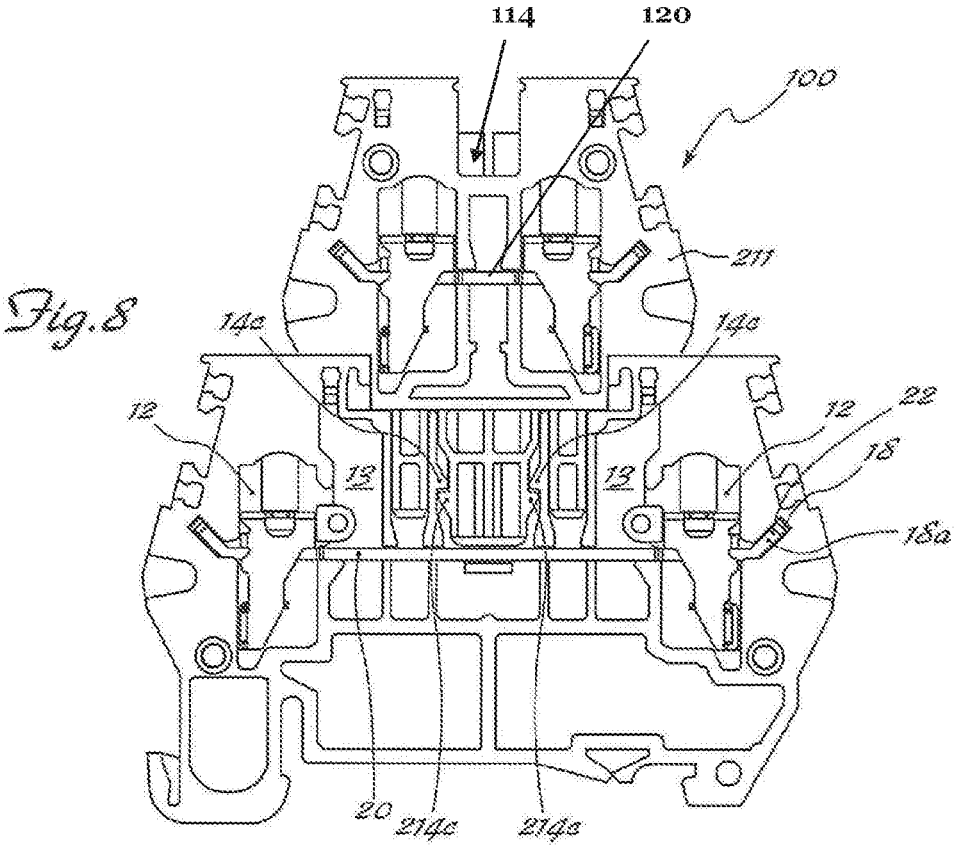
FIG. 8: shows a cross-sectional view, along a vertical plane, of a first preferred two-tier embodiment of the terminal block according to the invention.
Figure 9:
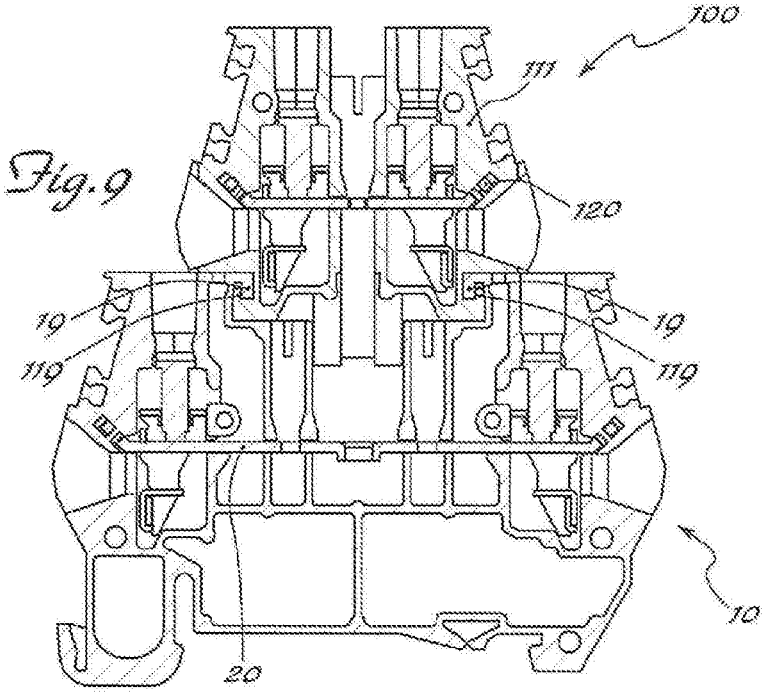
FIG. 9: shows a cross-sectional view, along a vertical plane, of a second preferred two-tier embodiment of the terminal block according to the invention.
Figure 10:
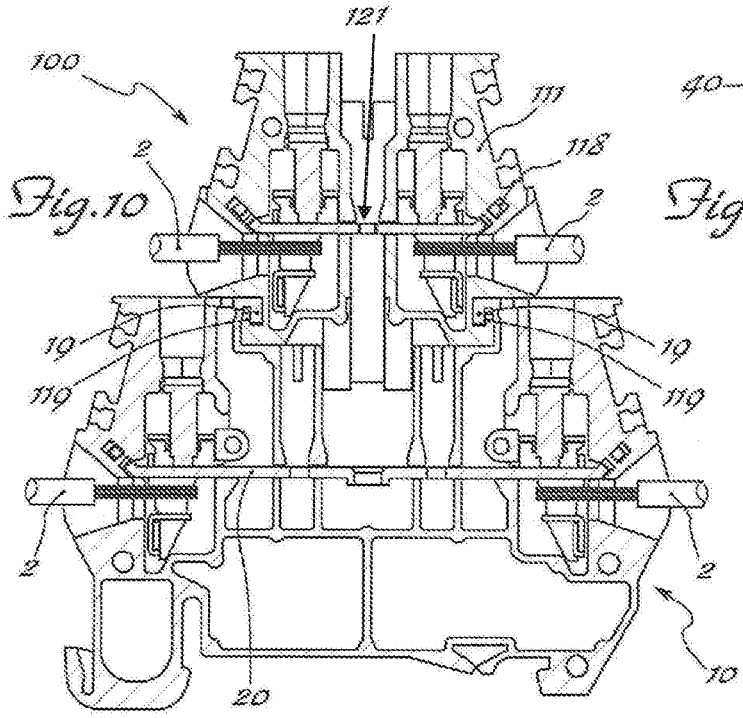
FIG. 10: shows a cross-section, similar to that of FIG. 9, with the upper terminal block complete with connecting jumper.
Figure 11:
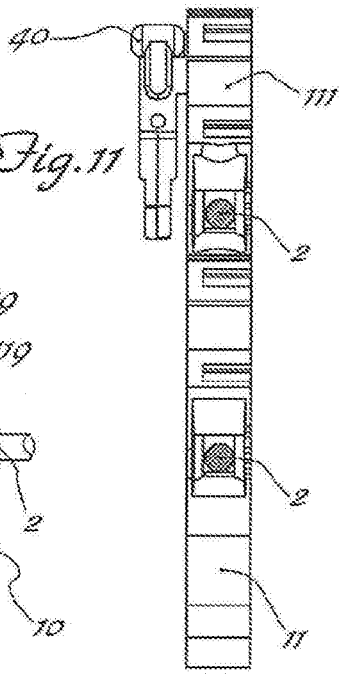
FIG. 11: shows a side view from the narrow side of the terminal block according to FIG. 10.
Figure 12:
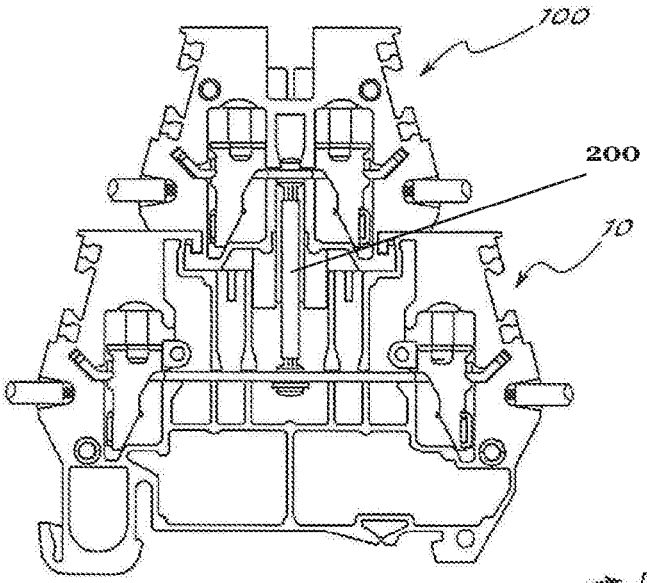
FIG. 12: shows a preferred variation of embodiment of the two-tier terminal block according to the invention.
Figure 13:
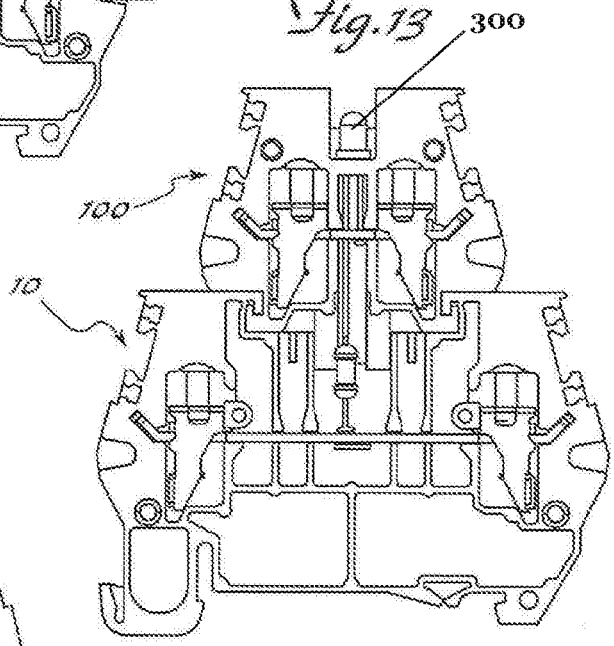
FIG. 13: shows a second variation of embodiment of the two-tier terminal block.

As shown in FIG. 7, a third preferred embodiment of the terminal block according to the invention is envisaged, said embodiment having:

- a pair of teeth 19 in the form of an "overturned L" formed on the outermost part of the opposite vertical edges of the undercut 16 formed in the frame 11 of the terminal block; the teeth 19 form a respective L-shaped inset seat 19*a* formed in the respective vertical edge of the undercut 16.

The teeth 19 with respective seat 19*a* are designed to receive corresponding projections 119 projecting outwards in the longitudinal direction X-X and formed in the bottom part of the frame 111 of an add-on terminal block 100.

The two frames 11,211 or 11,111 of the two terminal blocks, i.e., base terminal block and add-on terminal block, are joined together so as to form a two-tier—i.e. upper tier and lower tier—assembly according to the non-limiting directional layout shown in the figure.

Both upper-tier terminal blocks 100 have a structure similar to that of the lower terminal block, but have a single, small-size, central seat 114 for housing a jumper 40 with spring lugs 41; correspondingly the longitudinal conductor lamina 120 has a single polygonal opening 121 for allowing the insertion of the spring lugs 41 and the consequent electrical conduction contact as already described.

The other parts of the upper-tier terminal block 100 are similar to those of the lower terminal block and therefore will not be described in detail, but have lengthwise dimensions in the longitudinal direction X-X and vertical direction Z-Z slightly greater than the undercut 16 in the base terminal block.

The longitudinal dimension of the upper-tier terminal block 100 is such as to leave exposed the hole 12*a* for access to the screw for actuating the means 50 for gripping the bottom wire 2 against the conductor lamina 20.

As shown in the examples illustrated in FIGS. 10, 11, 12 and 13, with the two-tier structure it is possible to perform numerous different electrical connections in both the longitudinal direction X-X and transverse direction Y-Y; in detail

- a connection (FIG. 10, 11) of wires 2 both to the lower tier and to the upper tier with a spring-lug jumper 40 if necessary for performing the transverse connection Y-Y with an adjacent terminal block;
- a connection (FIG. 12) of wires 2 both to the lower tier and to the upper tier with electrical connection between the two tiers being performed by means of a conductor 200 extending in the vertical direction Z-Z and connected to the two conductor laminae central hole 21,121 of the lower tier and upper tier, respectively;
- a connection (FIG. 11) of wires 2 both to the lower tier and to the upper tier with electrical connection between the two tiers being performed using different circuit components, for example by means of a connection circuit with a signalling device 300 for example of the Light-emitting diode (LED) type.

Figure 14:
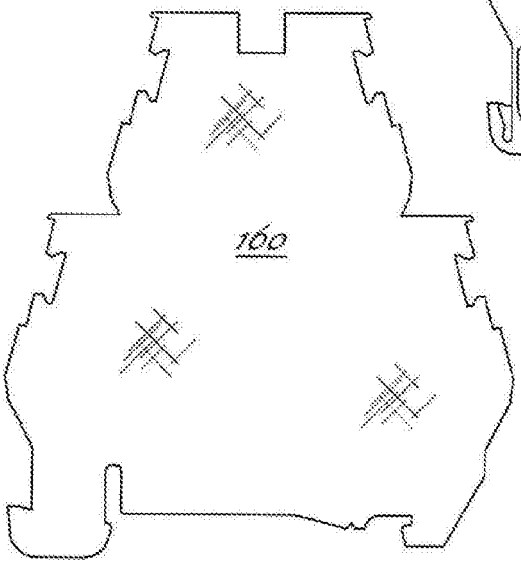
FIG. 14: shows a view of the closing cover of a two-tier terminal block according to the present invention.
Figure 15:
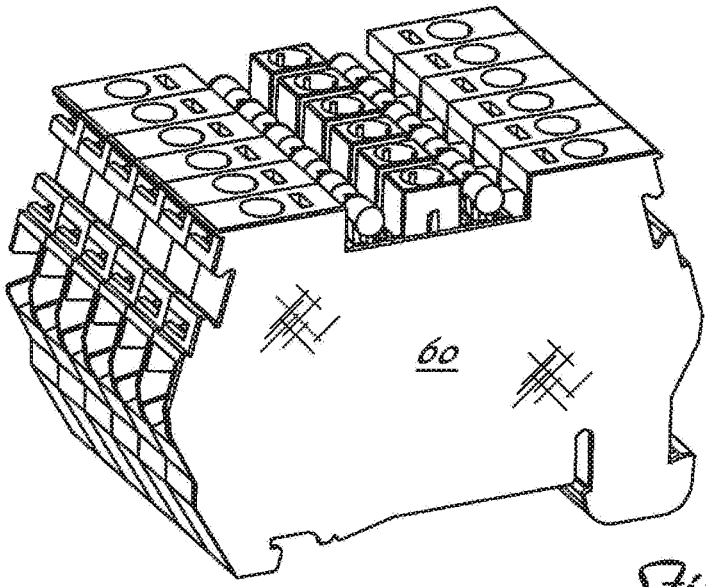
FIG. 15: shows a view of a plurality of terminal blocks according to the invention connected in the transverse direction and closed laterally.
Figure 16:
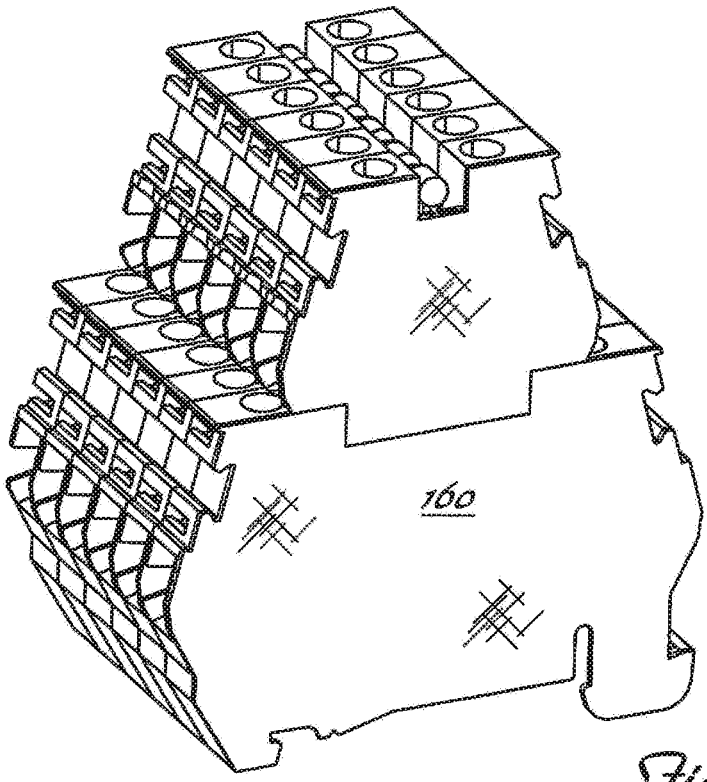
FIG. 16: shows a view of a plurality of two-tier terminal blocks according to the invention connected in the transverse direction and closed laterally.

The assembly of the two-tier terminal block is again similar to that of the base terminal block, although it is envisaged that in this case the closing cover 160 (FIG. 14) is formed as one piece so as to close both the upper and lower terminal blocks with a single operating action, thus reducing both the need to diversify the component parts and the management and the duration of the assembly steps.

It is therefore clear how the terminal block according to the invention is able to house equally well a jumper of the screw type and/or at the same time, at least one, but also two jumpers of the spring-lug type, having dimensions which lie within the standard minimum dimensions.

Furthermore, in addition to the configuration of the insulating body, the particular configuration of the central hole and the lateral openings in the conductor lamina prevent incorrect assembly operations since the spring-lug jumper would not make contact if inserted inside the threaded hole and the screw jumper screw would not have any grip inside the lateral holes.

The invention claimed is:

1. A switchboard multifunction terminal block for connecting electrical wires (2,2*a*), comprising:

- an insulating body (10) formed by a substantially closed-ring frame (11) and configured so as to define at least a top side (11*a*) and a bottom side, opposite in a vertical direction (Z-Z), and at least two respective flanks (11*b*) opposite in a longitudinal direction (X-X);

wherein inside the body (10) there is formed:

a first pair of seats (12) outermost in the longitudinal direction (X-X) towards the flanks (11*b*), symmetrical with respect to a vertical central axis (Z-Z), open in the transverse direction (Y-Y) and during use communicating with the exterior via a first respective opening (12*a*) extending in the vertical direction (Z-Z) to the top side (11*a*) of the frame (11); the seats (12) being adapted to house means (50) for gripping wires (2) which can be inserted longitudinally into the seats (12) from the frame (11) flanks (11*b*);

a first space (14) centred on the vertical central axis (Z-Z) and bounded in the longitudinal direction (X-X) by respective first partitions (14*a*) extending in the vertical direction (Z-Z) and vertically interrupted along a heightwise section so as to allow the insertion, in the transverse direction (Y-Y), of a longitudinal conductor lamina (20) designed to restore the electrical continuity between the wires (2), said first partitions (14*a*) being spaced from each other in the longitudinal direction (X-X) by an amount such as to define a size of the space suitable for housing a jumper (30) of the screw (32) type;

wherein the top side (11*a*) of the terminal block has a first central opening (16*b*) forming a communication with the exterior for the first space (14), for inserting the respective jumper of the screw type (30);

a pair of second spaces (15) respectively arranged symmetrically on opposite sides of the first space (14) relative to the vertical central axis (Z-Z), each second space (15) being bounded in the longitudinal direction (X-X) by respective second partitions (15*a*) extending in the vertical direction (Z-Z) and interrupted in the same direction along a heightwise section such as to allow the insertion of the conductor lamina (20) in the transverse direction (Y-Y); the second partitions (15*a*) being spaced in the longitudinal direction (X-X) from the first partitions (14*a*) by an amount such as to define a size of each second space (15) allowing housing of a respective jumper (40) of the type with spring lugs (41), wherein the top side (11*a*) of the terminal block has an undercut (16) with a base (16*a*);

said first central opening (16*b*) being formed on that base (16*a*);

wherein the base (16*a*) has two second lateral openings (16*c*) symmetrically arranged on opposite sides of the central opening (16*b*) relative to the vertical central axis (Z-Z);

wherein each of the two second lateral openings (16*c*) forms a communication with the exterior respectively, of a respective one of said pair of second spaces (15), for inserting the respective jumper (40) with spring lugs (40) in the vertical direction (Z-Z) from the top side (11*a*) accessible to an operator.

2. The terminal block according to claim 1, wherein said longitudinal conductor lamina (20) has a first central hole (21) with female thread (21*a*) designed to mate with the threading of the screw (32) of the screw-type jumper (30), and a pair of polygonal-shaped openings (23) symmetrically arranged on opposite sides of the central hole (21) relative to the vertical central axis (Z-Z), said central hole (21) and openings (23) being respectively coaxial with the central space (14) and the lateral spaces (15) respectively for engagement with the screw (32) of a screw-type jumper (30) and with the spring lugs (41) of a respective spring-lug jumper (40).

3. The terminal block according to claim 2, wherein the central hole (21) has a collar (21*b*) deep-drawn in the vertical direction (Z-Z) for allowing further screwing of the screw (32) of the screw-type jumper (30).

4. The terminal block according to claim 1, further comprising a rigid tooth (14*c*) extending in the longitudinal direction (X-X) from each first vertical partition (14*a*) towards the inside of the seat (14).

5. The terminal block according to claim 1, further comprising a pair of teeth (19) in the form of an overturned L formed on the outermost part of the opposite vertical edges (16*c*) of the undercut (16) in the substantially closed-ring frame (11), the teeth (19) forming a respective L-shaped recessed seat (19*a*) formed on the respective vertical edge (16*c*) of the undercut (16) for engagement with corresponding projections (119) projecting outwards in the longitudinal direction (X-X) and formed in the bottom part of the frame (111) of an add-on terminal block (100) having lengthwise dimensions in the longitudinal direction (X-X) and vertical direction (Z-Z) which are smaller than those of the terminal block.

6. The terminal block according to claim 1, wherein the visible top side (11*a*) comprises holes (13*a*) with a vertical axis (Z-Z) for insertion of a label/tag for identifying circuit connections.

* * * * *